United States Patent [19]

Fleischer

[11] 4,219,959

[45] Sep. 2, 1980

[54] TOY EGG

[76] Inventor: Charles J. Fleischer, 8212 W. Norton Ave., Los Angeles, Calif. 90046

[21] Appl. No.: 44,522

[22] Filed: Jun. 1, 1979

[51] Int. Cl.[3] ..... A63H 33/00
[52] U.S. Cl. ..... 46/1 R; 273/58 D
[58] Field of Search ..... 46/1 R; 273/1 R, 58 D, 273/58 R, 58 BA

[56] References Cited

U.S. PATENT DOCUMENTS

| | | | |
|---|---|---|---|
| D. 234,789 | 4/1975 | Rosenberg | 46/111 X |
| 4,114,306 | 9/1978 | Molenaar | 46/1 R |

FOREIGN PATENT DOCUMENTS

| | | | |
|---|---|---|---|
| 253028 | 3/1912 | Fed. Rep. of Germany | 273/58 D |

*Primary Examiner*—Louis G. Mancene
*Assistant Examiner*—Mickey Yu
*Attorney, Agent, or Firm*—Poms, Smith, Lande & Rose

[57] ABSTRACT

A toy adapted for pulling, stretching, and bouncing which includes two intertwined helically cut shells.

8 Claims, 4 Drawing Figures

TOY EGG

BACKGROUND OF THE INVENTION

1. Field of the Invention

This invention relates to toys, particularly to toys for manipulation with the hands, and more particularly to a toy which can be pulled, stretched, and bounced on a surface.

2. Description of the Prior Art

The prior art contains many toys which are intended to be manipulated by the hands, such as clays and dolls. Other toys have been invented which are intended to be pulled or stretched, such as spring-type toys and Silly-Putty brand putty. Further, the prior art is replete with toys and other items which are intended to be bounced on surfaces, such as rubber balls.

However, there has not been any prior art which combines the features and elements of the invention to be described herein.

It is the primary object of this invention to provide a novel toy.

It is another object of this invention to provide a novel toy which can be manipulated by the hands.

A further object of this invention is to provide a novel toy which can be stretched and pulled and returned to its original shape.

Yet another object of this invention is to provide a novel toy which can be bounced on a surface.

Further objects and advantages of this invention will become apparent to those skilled in the art from the following description.

SUMMARY OF THE INVENTION

The toy of this invention broadly includes two or more intertwined spiral helixes. For purposes of this invention, a helix is defined as a coil formed by winding an object about a longitudinal axis at an oblique angle so that it does not wind upon itself. A non-spiral helix is one wherein the curvature of the object has a constant radius about the axis. A spiral is the path of a point moving about an axis passing through the plane with a continually increasing or decreasing radius. A spiral helix is one wherein the curvature of the coil has a constantly increasing or decreasing radius.

DETAILED DESCRIPTION OF THE INVENTION

The toy of this invention comprises two or more intertwined or interlaced spiral helixes. In the preferred embodiment, each spiral helix is constructed from a spherical shell such as a table tennis ball. The spherical shell should be made of a resilient material such as a plastic or similar to the material of a table tennis ball so that the toy can withstand the stretching and bouncing intended for it. While the size of the spherical shell may be any convenient size, it is believed that a shell the approximate size of a table tennis ball, is preferable.

Figure 1:
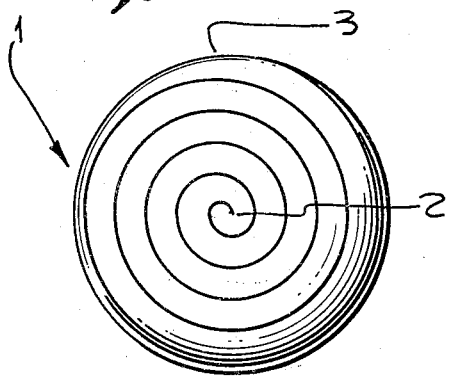
FIG. 1 is the top view of one spherical shell cut in the manner useful in this invention.

The spherical shell 1, such as shown in FIG. 1, is cut in the following manner. The cut begins at one point 2, which will define the longitudinal axis of the helix, and continues in an outwardly spiral manner until the spiral reaches its greatest radius at the "equator" 3 of the sphere. Thereafter the cut continues in an inwardly spiral manner until the cut reaches the point 4 on the shell at the other end of the axis.

Figure 2:
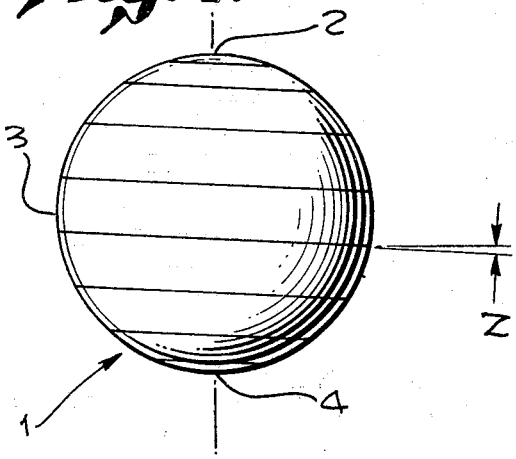
FIG. 2 is the side view of the spherical shell shown in FIG. 1.

The number of turns or revolutions of cuts will be dependent on the angle of the cut. As seen in FIG. 2, the oblique angle z represents the angle of the cut. The smaller the angle z, the more turns or revolutions there will be. While the angle z can vary widely, it is preferrable to have an angle z between 2 degrees and 15 degrees.

Figure 3:
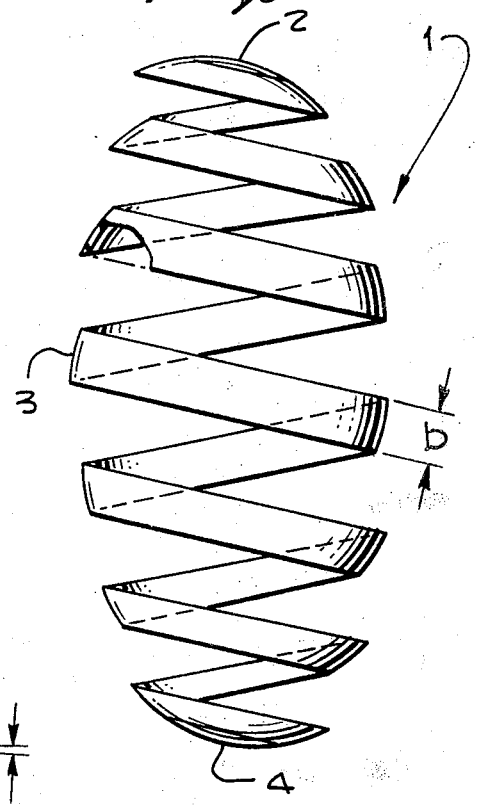
FIG. 3 is the shell of FIG. 2 shown in an extended position.

The cut can be made to produce a helix of various thicknesses, b, such as is shown in FIG. 3. While any convenient thickness can be used, it should be realized that the thinner the sections, the more turns or revolutions the helix will have. It is believed that it is preferable to provide a cut to produce a helix having a constant thickness between $\frac{1}{8}$ and $\frac{1}{2}$ inch.

Referring to FIG. 1, the cut shown is a counter-clockwise cut, using the axis as the starting point. While it is preferable to intertwine two helical shells that have been cut in the same direction (e.g. both clockwise, or both counter-clockwise), it is possible to intertwine a helical shell that has been cut counter-clockwise with one that has been cut clockwise.

Figure 4:
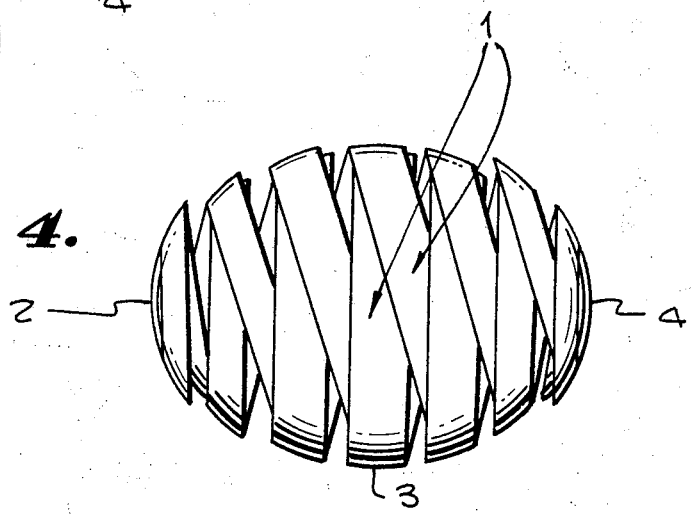
FIG. 4 is a side view of the toy egg of this invention showing two spherical shells, similar to that shown in FIG. 3, intertwined.

The helixes can be intertwined either in a parallel relationship such as is shown in FIG. 4, wherein the axes of the two helixes are parallel to each other or they can be intertwined in any other non-parallel relationship, for example such that the angle between their axes is 90 degrees.

Furthermore, while it is preferred to intertwine only two helixes, it may be desirable to intertwine more than two helixes (e.g. three of four). This could be done by intertwining the additional helixes either in parallel with one of the first two helixes or at an angle with the helixes.

The foregoing detailed description of the invention is exemplary only, and it should be understood that other modifications obvious to those skilled in the art may be made, and are intended to be within the scope of this invention, which is defined and limited only by the following claims.

I claim:

1. A toy comprising:

a first spherical shell cut into a helix;

a second spherical shell cut into a helix; and wherein said two helixes are intertwined with each other so as to produce an unitary toy.

2. The toy defined in claim 1 wherein said two shells are both cut in a clockwise direction.

3. The toy defined in claim 1 wherein said two shells are both cut in a counter-clockwise direction.

4. The toy defined in claim 1 wherein one shell is cut in a clockwise direction and the other shell is cut in a counter-clockwise direction.

5. The toy defined in claims 1, 2, 3, or 4 wherein each spherical shell has a diameter of between $\frac{1}{2}$ and $2\frac{1}{2}$ inches.

6. The toy defined in claim 1, 2, 3, or 4 wherein each shell is cut into a helix with an angle of between 2 and 15 degrees.

7. The toy defined in claim 5 wherein the thickness of the helix is between $\frac{1}{8}$ and $\frac{1}{2}$ inches.

8. The toy defined in claim 1 wherein the toy comprises more than two such intertwined helixes.

* * * * *